US007351163B2

(12) United States Patent
Shimazaki et al.

(10) Patent No.: US 7,351,163 B2
(45) Date of Patent: Apr. 1, 2008

(54) GOLF CLUB HEAD

(75) Inventors: Hideo Shimazaki, Tokyo (JP); Yasunori Imamoto, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 402 days.

(21) Appl. No.: 10/439,183

(22) Filed: May 16, 2003

(65) Prior Publication Data

US 2003/0236133 A1 Dec. 25, 2003

(30) Foreign Application Priority Data

May 16, 2002 (JP) ..... 2002-141236

(51) Int. Cl.
*A63B 53/04* (2006.01)

(52) U.S. Cl. ..... 473/345; 473/349

(58) Field of Classification Search ..... 473/324–350, 473/290–291

See application file for complete search history.

(56) References Cited

U.S. PATENT DOCUMENTS 5,501,459 A * 3/1996 Endo ..... 473/346
5,669,825 A 9/1997 Shira
5,935,019 A * 8/1999 Yamamoto ..... 473/338
5,967,905 A * 10/1999 Nakahara et al. ..... 473/345
6,012,990 A * 1/2000 Nishizawa ..... 473/345
6,062,988 A * 5/2000 Yamamoto ..... 473/324
6,099,414 A 8/2000 Kusano et al.
6,162,132 A * 12/2000 Yoneyama ..... 473/338
6,206,789 B1 * 3/2001 Takeda ..... 473/335
6,319,149 B1 * 11/2001 Lee ..... 473/342
6,341,723 B1 1/2002 Nakahara et al.

FOREIGN PATENT DOCUMENTS

JP 7-216490 A 8/1995
JP 9-266965 A 10/1997
JP 10-94623 A 4/1998
JP 10-151231 A 6/1998
JP 10-225538 A 8/1998
JP 11-248973 A 9/1999

(Continued)

OTHER PUBLICATIONS

Japanese Office Action dated Nov. 7, 2006, with translation.

(Continued)

*Primary Examiner*—Sebastiano Passaniti
(74) *Attorney, Agent, or Firm*—Sughrue Mion, PLLC

(57) ABSTRACT

A head body of a golf club head has a hollow portion defined by an outer wall. An opening portion is provided in a part of the head body. A small tungsten alloy piece having a shape fittable to the opening portion so as to cover the opening portion is fixedly attached to the opening portion by welding. The golf club head defines the opening portion in a part of the metal head body and has the small tungsten alloy piece fitted and joined to the opening portion by welding so that the golf club head can be reduced in weight because of provision of the hollow portion. Since the small tungsten alloy piece is joined to the opening portion by welding, difficult plastic forming is not required particularly, and the weight can be adjusted easily and accurately.

9 Claims, 6 Drawing Sheets

FOREIGN PATENT DOCUMENTS

| | | | |
|---|---|---|---|
| JP | 3070587 | U | 5/2000 |
| JP | 2000-233034 | A | 8/2000 |
| JP | 2000-254260 | A | 9/2000 |
| JP | 2001-212272 | A | 8/2001 |
| JP | 2002-119627 | A | 4/2002 |

OTHER PUBLICATIONS

Japanese Office Action dated Jan. 30, 2007, with translation.

* cited by examiner

GOLF CLUB HEAD

The present disclosure relates to the subject matter contained in Japanese Patent Application No. 2002-141236 filed on May 16, 2002, which is incorporated herein by reference in its entirety.

BACKGROUND OF THE INVENTION

1. Field of the Invention

The present invention relates to a golf club head, and particularly relates to a golf club head suitable for application as a fairway wood.

2. Description of the Related Art

Tungsten alloys to be formed as a weight member for a golf club head are too bad in workability. In the related art, tungsten alloys have been therefore used in the form in which sintered tungsten is cast in and inserted into a cast head or in the form in which tungsten powder is mixed together with expanded resin in a hollow portion so as to be used as a weight control material. In recent years, however, in order to improve the bad workability of tungsten alone, tungsten alloys, which have good workability, such as a tungsten-nickel alloy and a tungsten-copper alloy, have been developed as disclosed in JP-A-Hei.7-216490. Thus, a weight member can be fixed by plastically forming the tungsten alloys using a caulking technique as disclosed in JP-A-Hei.10-94623 and JP-A-Hei.10-225538.

However, when such plastic forming is performed, it is necessary to perform die-cutting or cutting for forming the weight member into a proper shape or for adjusting the weight of the weight member accurately. Thus, stringent control has been required.

SUMMARY OF THE INVENTION

It is therefore an object of the invention to provide a golf club head, which has weight set accurately and is superior in productivity.

In order to solve the foregoing problem, according to the invention, a golf club head has a metal head body and a metal piece. The metal head body defines a hollow portion and an opening portion. The metal piece is joined to the opening portion by welding. The metal piece includes tungsten alloy.

In the golf club head according to the invention, the head body can be made light in weight due to the hollow portion provided therein. In addition, since the small tungsten alloy piece is joined to the opening portion by welding, difficult plastic forming is not required particularly. It is therefore possible to adjust the weight easily and accurately.

It is preferable that the specific gravity of the metal head body is set to be not higher than 8.5.

When the metal head body is set thus to be not higher than 8.5, the head body can be made light in weight. For example, there is no particular problem in the weight when the head volume is set to be not smaller than 150 cc and not larger than 220 cc so that the dimensions of the head are made easy for golfers to handle as a fairway wood.

Materials shown in Table 1 can be applied suitably as the metal material whose specific gravity is not higher than 8.5.

TABLE 1

| Material Name | chemical composition |
|---|---|
| high tension steel (HT80) | 0.12C—0.8Mn—1.0Ni—0.5Cr—0.4Mo |
| manganese steel for machine structural use | (0.4~0.6)C—(0.7~2.0)Mn |
| chromium steel (SCr430) | 0.3C—0.7Mn—1.05Cr |

TABLE 1-continued

| Material Name | chemical composition |
|---|---|
| chromium-molybdenum steel (SCM440) | 0.4C—0.7Mn—1.05Cr—0.25Mo |
| nickel-chromium steel | (0.25~0.55)C—(1.0~5.0)Ni—(0.3~2.0)Cr |
| case hardening steel | (0.09~0.25)C—(0.55~1.50)Cr |
| steel for low temperature service | 3Ni |
| steel for low temperature service | 9Ni |
| maraging steel (250) | 18Ni—8Co—5Mo |
| martensitic stainless steel (SUS410) | 0.15C—12.5Cr |
| ferritic stainless steel (SUS405) | 0.08C—13Cr |
| austenitic stainless steel (SUS304) | 18Cr—8Ni |
| precipitation hardened stainless steel (SUS631) | 17Cr—7Ni—1.1Al |
| precipitation hardened stainless steel (SUS630) | 17Cr—4Ni—4Cu—0.15Nb |
| high manganese steel (Hadfield steel) | (0.8~1.4)C—(10~15)Mn |

specific gravity of the metal piece is in a range of 10-12.

As a result, it is possible to obtain the metal piece having an effective function as a weight on the metal head body, particularly on the metal head body whose specific gravity is not higher than 8.5.

It is preferable that the metal head body is made of stainless steel.

When the head body is made of stainless steel, strength and corrosion resistance sufficient as a golf club head can be provided.

The metal piece may be produced by casting.

Accordingly, it is possible to efficiently produce a metal piece having a required capacity, a required shape and a required weight.

Any gravity casting generally carried out is applicable as the casting method applied to the invention. Precision casting, particularly a lost wax process can be applied suitably. According to the lost wax process, dimensional accuracy of casting as cast not wider than ±0.5% can be obtained as to products about 0.5-1.5 mm thick. Thus, the metal piece for adjusting the weight according to the invention can be produced with high accuracy in the lost wax process.

The metal piece may include the following compositions based on the total weight of the metal piece: tungsten in a range of 25 wt %-32 wt %, preferably in a range of 28 wt %-32 wt %, iron in a range of 43 wt %-49 wt %, preferably in a range of 45 wt %-49 wt %, nickel in a range of 13 wt %-17 wt %, preferably in a range of 15 wt %-17 wt %, copper in a range of 1 wt %-3 wt %. The sum of amount of tungsten, iron, nickel, and copper in the metal piece may be in a range of 93 wt % to 98 wt %. Whereby the metal piece can be made effective from the points of view of weldability, workability, weight control ability, and the like. Accordingly, it is possible to efficiently produce a golf club head durable and user-friendly.

When the composition of the metal piece is prepared so that sum of amount of Ni and Cu in the metal piece is in a range of 16 wt %-20 wt %, it is possible to obtain a golf club head superior in corrosion resistance. Therefore, there occurs no particular corrosion even in an environment weathered by wind and water. Particularly, such corrosion resistance is recognized conspicuously in the welded portion between the metal piece and the head body.

When the small tungsten alloy piece is welded to range from a central portion or a rear of a center of a sole portion or from rearward of the sole portion to a side wall of a back portion, it is possible to obtain a golf club head having high performance. That is, when the metal piece is welded to such a portion so as to adjust the weight, it is possible to produce a golf club head low in center of gravity accurately. Thus, the golf club head can be made capable of reducing missed shots and hitting a shot producing a strong fly ball.

BRIEF DESCRIPTION OF THE DRAWINGS

FIG. 6 is a view showing a welded portion between a small tungsten alloy piece and a golf club head.

DETAILED DESCRIPTION OF THE PREFERRED EMBODIMENTS

Figure 1:
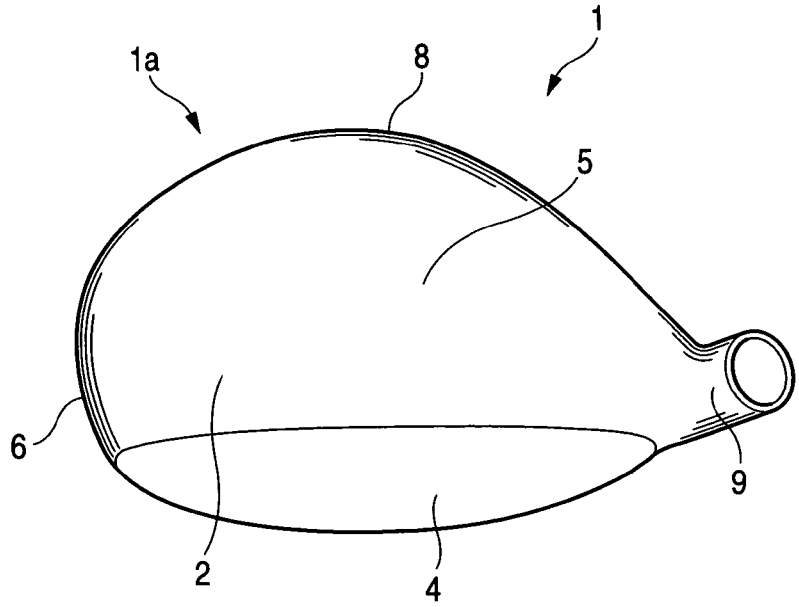
FIG. 1 is a perspective view of a golf club head according to an embodiment of the invention, viewed from its top.
Figure 2:
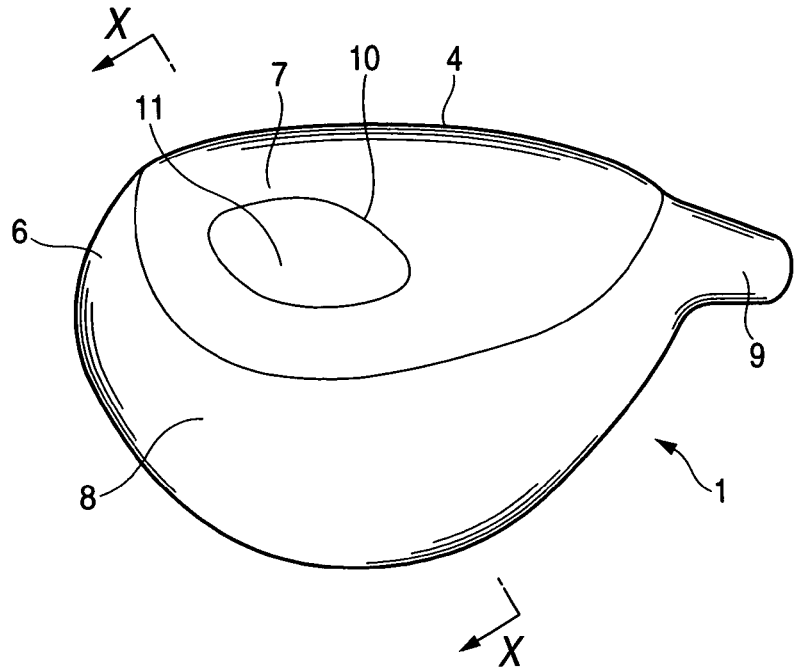
FIG. 2 is a perspective view of the golf club head according to the embodiment of the invention, viewed from its bottom.
Figure 3:
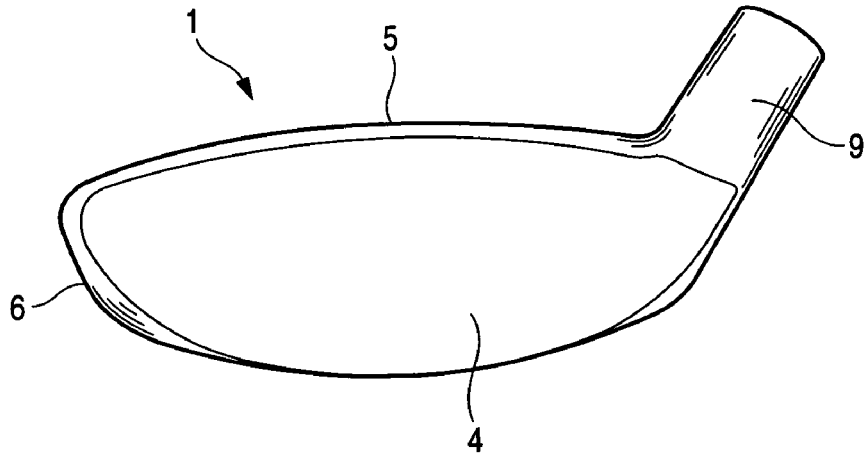
FIG. 3 is a side view of the golf club head according to the embodiment of the invention.
Figure 4:
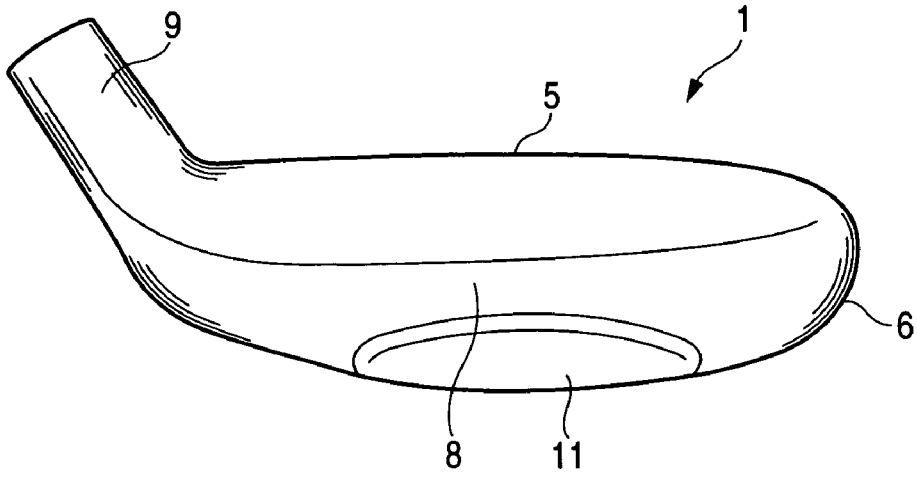
FIG. 4 is another side view of the golf club head according to the embodiment of the invention.
Figure 5:
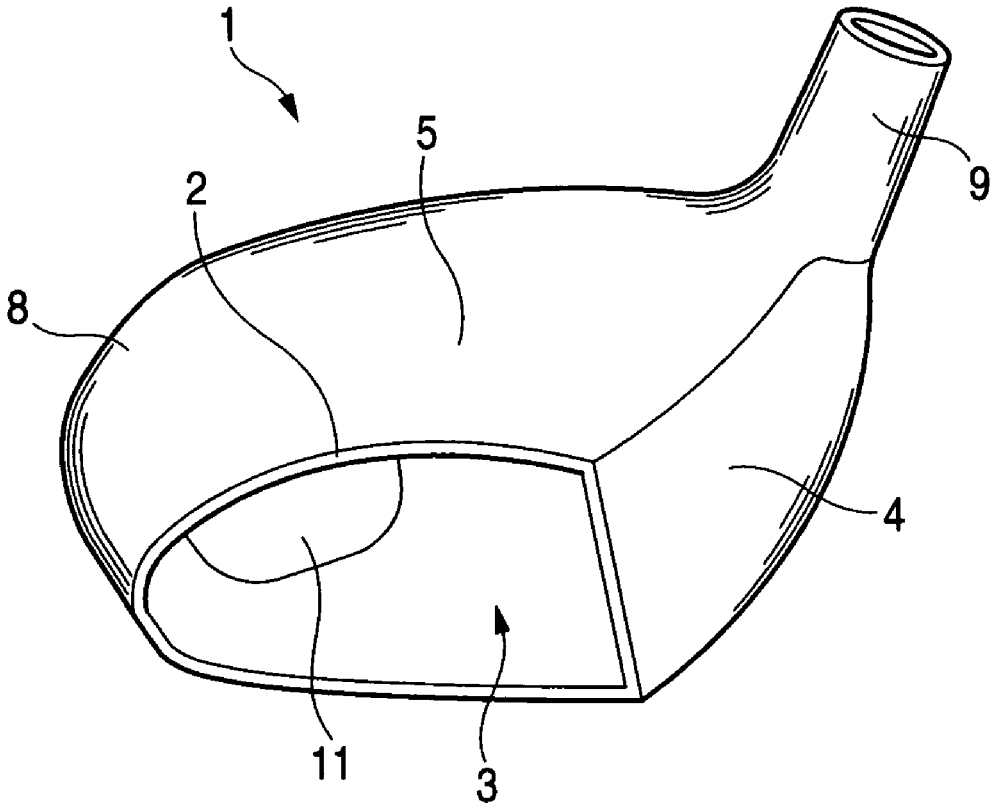
FIG. 5 is a partially cutaway perspective view of the golf club head according to the embodiment of the invention.

An embodiment of the invention will be described with reference to the drawings.

As shown in FIGS. 1 to 5 and 7, a head body 1*a* of a golf club head 1 according to the invention has a hollow portion 3 defined by an outer wall 2. The outer wall 2 includes a face portion 4, a crown portion 5, a side portion 6, a sole portion 7, a back portion 8 and a hose 19. An opening portion 10 is defined in a part of the head body 1*a*. A small tungsten alloy piece 11 is shaped to be able to be fitted to the opening portion 10 so as to cover the opening portion 10. The small tungsten alloy piece 11 is fixedly attached to the opening portion 10 by welding.

The face portion 4 preferably has 2 mm-3.5 mm in thickness to thereby secure strength against the impact of a ball. When the thickness is not smaller than 3.5 mm, the weight is so excessive that the golf club head 1 cannot be made larger. On the contrary, when the thickness is smaller than 2 mm, the strength against the impact of a ball becomes insufficient.

The crown portion 5, the side portion 6 and the sole portion 7 preferably have 0.5 mm-2.5 mm in thickness, more preferably about 0.7 mm-about 2.2 mm in thickness.

When the thickness is smaller than 0.5 mm, the running of molten metal in gravity casting, particularly in precision casting using a lost wax process deteriorates. Thus, it becomes difficult to secure the accuracy. On the contrary, when the thickness exceeds 2.5 mm, the weight becomes too excessive to make the golf club head 1 larger. Incidentally, the sole portion 7 maybe formed thick appropriately in order to lower the center of gravity of the golf club head 1. To this end, it is allowed to increase the thickness of the sole portion 7 partially or wholly up to 3 mm.

As for a position where the opening portion 10 should be defined in the head body 1*a*, particularly the sole portion 7 or the side portion 6 is preferred. Specifically, the position where the opening portion 10 should be defined is set to range from the central portion or the rear of the center of the sole portion 7 or from the rearward of the sole portion 7 to the side wall of the back portion 8. When the small tungsten alloy piece 11 is welded to the opening portion 10, the center of gravity of the golf club head 1 can be lowered suitably.

The head body 1*a* of the golf club head 1 according to the invention is made of metal. Particularly, a metal material whose specific gravity is not higher than 8.5 is applied to the head body 1*a*. As a material, which can be used as the metal material, stainless steel is suitable. Specific examples of the stainless steel, which can be used, include SUS630, SUS304 and SUS431. Particularly the golf club head 1 according to the invention is preferably applied to a golf club head 1 having a hollow portion, and preferably applied to a head for a fairway wood, which does not have to have a very large head volume. That is, when the head volume is set to be not smaller than 150 cc and not larger than 220 cc in a golf club head 1 having a loft angle of not smaller than 13° and not larger than 25°, it is possible to make a fairway wood have a volume and a loft angle easy for golfers to handle.

In addition, according to the invention, an iron base tungsten alloy can be applied to the small tungsten alloy piece 11 fitted to the opening portion 10 of the head body 1*a* so as to cover the opening portion 10. The small tungsten alloy piece 11 using such an iron base tungsten alloy is fitted to the opening portion 10 of the head body 1*a* for covering the opening portion 10, and fixedly attached thereto by welding.

Description will be made below on the composition of the iron base tungsten alloy applicable to the small tungsten alloy piece 11.

(1) Tungsten (W) Specific Gravity 19.3 (g/cc at 20° C.)

When the small tungsten alloy piece 11 contains tungsten (W), the specific gravity thereof can be increased so that the small tungsten alloy piece 11 is effective as a weight material. However, when the content of tungsten is increased to be too large, the weldability generally deteriorates. Therefore, in the invention, it is preferable that tungsten accounts for the ratio more than 25% of the material alloy of the small tungsten alloy piece 11, more preferably the ratio 28% -32%.

When the content of tungsten is lower than 25%, the specific gravity cannot be increased sufficiently. On the contrary, when the content of tungsten exceeds 32%, the weldability deteriorates excessively so that it becomes difficult to fit the obtained small tungsten alloy piece 11 to the opening portion 10 of the head body 1*a* and fixedly attach the small tungsten alloy piece 11 to the opening portion 10 by welding.

(2) Iron (Fe) Specific Gravity 7.87

When the content of iron (Fe) is increased, arc welding, TIG welding or MIG welding generally applied to welding of stainless steel can be applied normally to weld the small tungsten alloy piece 11 according to the invention with the stainless steel golf club head 1 easily. That is, the content of Fe is in a range of 43% -49% in order to improve the weldability of Fe with stainless steel. When the content of Fe is not higher than 40%, the weldability cannot be improved sufficiently. On the contrary, it is not preferable that the content of Fe exceeds 49%. That is, when the content of Fe exceeds 49%, the effect of adding W on increase of the specific gravity becomes too insufficient to attain the purpose of the small tungsten alloy piece 11 as a weight according to the invention. Specifically, when the specific gravity of the stainless steel golf club head 1 is about 7.8 and the content of Fe exceeds 49%, the effect of adding tungsten (W) on increase of the specific gravity becomes insufficient so that the specific gravity of the small tungsten alloy piece 11 is close to the specific gravity of the stainless steel golf club head 1. Thus, the small tungsten alloy piece 11 cannot serve as a weight material sufficiently.

The content of Fe is preferably in a range of 43% -49%, more preferably in a range of 45% -49%. As a result, the weldability can be improved as much as possible while the effect of adding W on increase of the specific gravity is kept sufficient.

(3) Nickel (Ni) Specific Gravity 8.902

When nickel (Ni) is contained, the corrosion resistance can be improved. To this end, the content of Ni is not lower than 13%, preferably 15% -17%.

When the content of Ni is not higher than 10%, the corrosion resistance deteriorates so that the practicability of the stainless steel golf club head 1 mounted with the small tungsten alloy piece 11 is lost. When the content of Ni is lower than 13%, the practicability may not be lost, but the corrosion resistance cannot be improved sufficiently. On the contrary, it is not preferable that the content of Ni exceeds 17%. That is, when the content of Ni exceeds 17%, the overall strength and the overall specific gravity are too small to attain the purpose of the small tungsten alloy piece 11 according to the invention.

(4) Copper (Cu) Specific Gravity 8.96

When Cu is contained, the corrosion resistance can be improved. To this end, the content of Cu is not lower than 1% and lower than 10%.

When the content of Cu is lower than 1%, the corrosion resistance cannot be improved sufficiently. On the contrary, it is not preferable that the content of Cu is not lower than 10%. That is, when the content of Cu is not lower than 10%, there occurs a softening tendency while the specific gravity becomes too small to attain the purpose of the small tungsten alloy piece 11 according to the invention.

The preferable content of Cu is in a range of 1% -5%, and the more preferable content of Cu is in a range of 1% -3%.

(5) Sum of Contents of Nickel (Ni, Specific Gravity 8.902) and Copper (Cu, Specific Gravity 8.96): Average Specific Gravity 8.931

The sum of contents of nickel (Ni) and copper (Cu) is controlled to be in a range of 16% -20%.

As a result, the corrosion resistance can be improved overall.

When the sum of contents of nickel (Ni) and copper (Cu) is lower than 16%, the corrosion resistance deteriorates so that the practicability of the stainless steel golf club head 1 mounted with the small tungsten alloy piece 11 is lost. On the contrary, it is not preferable that the sum of contents of nickel (Ni) and copper (Cu) exceeds 20%. That is, when the sum of contents of nickel (Ni) and copper (Cu) exceeds 20%, the whole strength and the whole specific gravity are too small to attain the purpose of the small tungsten alloy piece 11 according to the invention.

(6) Remaining Metal Components and Unavoidable Impurities (Zn: Specific Gravity 7.133, A1: Specific Gravity 2.699, Mn: Specific Gravity 7.43, Cr: Specific Gravity 7.19, Si: Specific Gravity 2.33, C: Specific Gravity 2.25, Pb: Specific Gravity 11.34, and Mo: Specific Gravity 10.22): Average Specific Gravity 7.57

The content of metal elements other than W, Ni, Fe and Cu is preferably set to be not higher than 10%, more preferably set to be in a range of 2% -7%. When the content of metal elements other than W, Ni, Fe and Cu exceeds 10%, the whole specific gravity regulation ability and excellent weldability, which are supposed to be obtained by containing W, Ni, Fe and Cu, cannot be obtained. The content of the other metal elements leads directly to a failure in welding. On the contrary, it is disadvantageous in an industrial production process that the content of metal elements other than W, Ni, Fe and Cu is lower than 2%. That is, when the content of metal elements other than W, Ni, Fe and Cu is lower than 2%, it is necessary to control each of the components W, Ni, Fe and Cu accurately to excess. On the other hand, it is not preferable that the content of metal elements other than W, Ni, Fe and Cu exceeds 7%. That is, when the content of metal elements other than W, Ni, Fe and Cu exceeds 7%, there occurs a tendency to fail to obtain specific gravity regulation ability and excellent weldability. Thus, the purpose of the small tungsten alloy piece 11 according to the invention cannot be attained.

(6) Chromium (Cr) Specific Gravity 7.19

In the invention, stainless steel is applied to the golf club head 1. The corrosion resistance of stainless steel is secured by Cr (chromium) contained in the stainless steel. Specifically, every thin oxide film of Cr is formed on a surface layer of the stainless steel so as to form a mechanism as a passive film for preventing under-film corrosion. Thus, corrosion resistance is secured. With regard to welding of such stainless steel, when normal stainless steel such as SUS304 is welded, the following problem can be generally suggested. That is, when a welded portion once melt is solidified again, Cr in the steel is bonded with C (carbon) in the steel so as to form chromium carbide making no contribution to corrosion resistance. This phenomenon causes shortage of Cr contributing to the corrosion resistance in the welded portion so that there may occur local corrosion in the welded portion. As a countermeasure against the local corrosion in the welded portion and in its heat affected portion, for example, application of a steel type having a low content of C, such as SUS304L, to the golf club head 1 may be adopted, besides controlling of the content of Cr. For this reason, it is important to control the content of remaining metal elements and unavoidable impurities, particularly the content of C (carbon).

On the other hand, an iron base tungsten alloy is applied to the small tungsten alloy piece 11. The corrosion prevention mechanism in the iron base tungsten alloy is different from the corrosion prevent mechanism in stainless steel. That is, the corrosion resistance in the iron base tungsten alloy is secured by the addition of Ni and Cu, which are corrosion-resistant elements as described above. Accordingly, in the small tungsten alloy piece 11, the following negative function is dominant. That is, Cr is bonded with C (carbon) to form chromium carbide making no contribution to corrosion resistance. For this reason, in the small tungsten alloy piece 11 to be mounted on the golf club head 1 according to the invention, the content of chromium (Cr) is limited to be lower than 10%. It is not preferable that the content of chromium (Cr) is not lower than 10%. That is, when the content of chromium (Cr) is not lower than 10%, the weldability deteriorates due to the phenomenon that Cr is bonded with C (carbon) contained as an unavoidable impurity to thereby form chromium carbide. Specific Gravity of Small Tungsten Alloy Piece: 10-12

When the small tungsten alloy piece 11 applied to the golf club head according to the invention has the aforementioned composition, the small tungsten alloy piece 11 controlled to have a specific gravity of about 10-about 12 can be manufactured efficiently. When the specific gravity of the small tungsten alloy piece 11 is made too large beyond 12, the balance among the constituent elements is lost so that the weldability or the solubility deteriorates. Thus, it becomes difficult to apply the small tungsten alloy piece 11 in an industrial production process. On the contrary, when the specific gravity of the small tungsten alloy piece 11 is made too small below 10, the effect to increase the specific gravity based on the content of tungsten (W) becomes insufficient. Thus, the specific gravity of the small tungsten alloy piece 11 becomes close to the specific gravity of the golf club head 1 so that the small tungsten alloy piece 11 cannot fulfill a function as a weight material satisfactorily. Method for Manufacturing the Small Tungsten Alloy Piece 11

When the small tungsten alloy piece 11 to be mounted on the stainless steel golf club head 1 according to the invention has the aforementioned composition, the small tungsten alloy piece 11 can be manufactured in a normal gravity casting process. Alternatively, the small tungsten alloy piece 11 can be formed by casting particularly in a lost wax process. Accordingly, casting equipment for casting the golf club head 1 can be applied directly to the production of the small tungsten alloy piece Incidentally, the golf club head 1 according to the invention is not particularly limited to a cast golf club head. A golf club head 1 produced in a plastic forming process such as press molding or forging may be used.

Generally, mass-produced metal golf club heads are slightly different from each other in size. For example, the lost-wax process for casting a metal golf club head includes the following steps:

(1) A melted wax is pressed into a mold having the same space as a shape of the golf club head and is hardened. Then, the hardened wax is picked up from the mold. Hereinafter, this hardened wax is referred to as a wax model (an injection step).

(2) Subsequently, the wax models are bonded to a runner channel (referred to as a "runner") to be like branches so that a lot of products (golf club heads) can be made in a single filling. This is referred to as a "tree" (an assembly step).

(3) The wax models (tree) prepared in the previous step are impregnated into a sludge-like material called a "slurry" in which a fireproof liquid bond and a fireproof powder are mixed. This process is referred to as a "coating". Then, the wax models are sprinkled with fireproof sand just after the coating. This process is referred to as a "stuccoing". After that, the wax models (tree) are dried for a while. Then, the processes of the coating→the stuccoing→the drying are repeated again several times to thicken the mold having a shell shape (a coating step).

(4) The wax models (tree) are accommodated in a device referred to as an "autoclave". Then, only the wax in the mold is flown out by steam at high temperature and high pressure (a dewaxing step).

(5) The mold is baked in a baking furnace at 800° C.-1100° C. for 40minutes-50minutes to strengthen the mold (a baking step)

(6) Molten metal is filled into the mold at high temperature immediately after picking up it from the baking furnace (a casting step).

(7) The mold is left stand until the metal filled into the mold having the shell shape solidifies. Then, the mold having the shell shape is split to pickup the solidifying metal. The products (golf club heads) are picked up from a trunk (the runner) of the trees made of the metal (a mold breaking step)

(8) The coating material is removed from the products (the golf club heads) picked up from the trees by blasting or the like (a finishing step).

In these steps, the shrinkage degrees of the golf club heads at a time when the wax are hardened and/or at a time when the metal forming each golf club head solidifies are slightly different from each other. Therefore, it is impossible to make the golf club heads, which are completely identical to each other.

Figure 8:
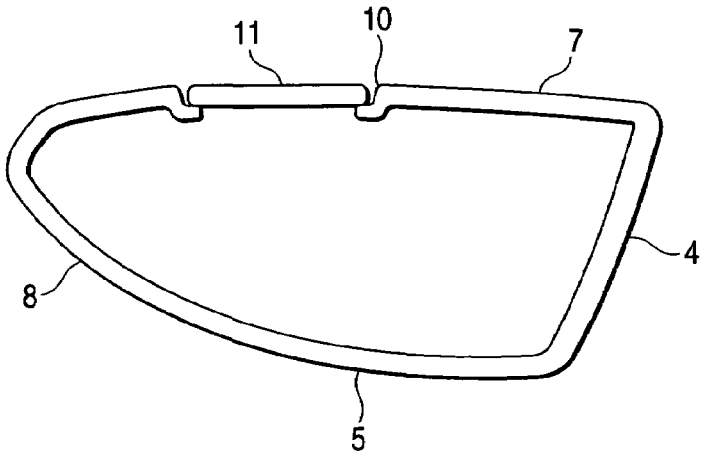
FIG. 8 is a view showing a section of the golf club head before welding the tungsten alloy piece, taken along a line X-X in FIG. 2.

On this account, it is important to design the small tungsten alloy piece 11 and the opening portion 10 so that a slight gap is formed therebetween when the small tungsten alloy piece 11 is fitted to the elliptic opening portion 10 as shown in FIG. 8.

In this case, the small tungsten alloy piece 11 and the opening portion 10 can be welded by the arc welding (for example, TIG welding or MIG welding) while the gap is being filled using a welding electrode. Assuming that the head body is made of a stainless steel. The iron-base small tungsten alloy piece 11 according to the embodiment of the invention is fitted to the elliptic opening portion 10. Then, they are welded using a welding electrode for stainless steel. When bead formed during welding is polished and removed, the golf club head can be formed in which the welded portion is inconspicuous. This is because each of the iron-base small tungsten alloy piece 11 and opening portion 10 contain a large quantity of iron component. Also, the plasma welding using powders can form the bead and weld the iron-base small tungsten alloy piece 11 and the opening portion 10 while filling the gap therebetween.

The laser welding also can fit the iron-base small tungsten alloy piece to the elliptic opening portion 10 of the head body. However, in the laser welding, they are processed mechanically and fitted to each other without a gap, and then contact portions of both of them are welded to join. Therefore, quite high accuracy is required. On the contrary, according to the embodiment of the invention, even if the general arc welding is employed, the iron-base tungsten alloy can be welded to the gold club head easily and cleanly. This is one of features of the invention.

EXAMPLES

Each golf club head 1 used in examples had a loft angle of 15°, a head volume of 170 cc and a head weight of 218 g. A face portion 4 was set to have 2.7 mm in thickness, while the other portions, that is, a crown portion 5, a side portion 6 and a sole portion 7 were set to have 2.0 mm in thickness, respectively. SUS630 stainless steel was used as the material of the golf club head 1. An elliptical opening portion 10 was formed to range from the rearward of the sole portion 7 to the side surface of the back portion. A small tungsten alloy piece 11 made of an iron base tungsten alloy according to the invention to serve as a weight material was fitted to the elliptical opening portion 10 so as to cover the opening portion 10, and fixedly attached thereto by welding.

This small tungsten alloy piece 11 was manufactured by casting in a lost wax process. At that time, the small tungsten alloy piece 11 was formed to have a weight of 30 g and to have an outer edge of 2 mm as long as the thickness of the head opening portion 10 in order to bring the small tungsten alloy piece 11 in contact with the inner edge of the elliptical opening portion 10. In addition, the central portion of the small tungsten alloy piece 11 was set to have 3 mm in thickness. The composition of the small tungsten alloy piece 11 was set as shown in Table 2.

Incidentally, in the small tungsten alloy piece 11 according to the invention, the specific gravity of W is about twice as large as that of any other constituent element, and hence the ratio of the component W is a dominant factor for determining the specific gravity of the obtained small tungsten alloy piece 11. In consideration of this point, the ratios of components in the respective examples. shown in Table 2 were set so that the ratio of the component W was fixed while the contents of other components were set variously.

TABLE 2

| | W | Fe | Ni | Cu | other metal elements and unavoidable impurities |
|---|---|---|---|---|---|
| Example 1-1 | 25 | 49 | 17 | 2 | 7 |
| Example 1-2 | 28 | 46 | 17 | 2 | 7 |
| Example 1-3 | 28 | 45 | 17 | 3 | 7 |
| Example 1-4 | 28 | 47 | 15 | 3 | 7 |
| Example 2-1 | 32 | 49 | 15 | 2 | 2 |
| Example 2-2 | 32 | 46 | 17 | 2 | 3 |
| Example 2-3 | 32 | 45 | 17 | 3 | 3 |
| Example 2-4 | 32 | 45 | 17 | 2 | 4 |
| Example 3-1 | 32 | 49 | 15 | 1 | 3 |
| Example 3-2 | 32 | 49 | 13 | 1 | 5 |
| Example 3-3 | 32 | 4943 | 1015 | 23 | 7 |

*expressed in wt % based on the total weight of the small tungsten allow piece 11 in each of examples and comparative examples
The small tungsten alloy piece 11 according to each example was fixed to the elliptical opening portion 10 of the golf club head 1 by welding. Welding was carried out by butt welding based on TIG welding and one-pass welding based on manual welding. After the welding, weld beads bulging on the surface of the sole portion 7 were pared by grinding so that the surface was made flat.

Comparative Examples

As comparative examples, small tungsten alloy pieces 11 having compositions shown in Table 3 were manufactured, respectively, just in the same manner as the examples.

TABLE 3

| | W | Fe | Ni | Cu | other metal elements and unavoidable impurities |
|---|---|---|---|---|---|
| Comparative Example 1-1 | 25 | 40 | 17 | 3 | 15 |
| Comparative Example 1-2 | 28 | 41 | 17 | 2 | 12 |
| Comparative Example 1-3 | 28 | 37 | 18 | 6 | 11 |
| Comparative Example 1-4 | 28 | 36 | 17 | 5 | 14 |
| Comparative Example 2-1 | 32 | 39 | 20 | 2 | 7 |
| Comparative Example 2-2 | 32 | 38 | 21 | 2 | 7 |
| Comparative Example 2-3 | 32 | 35 | 15 | 2 | 16 |
| Comparative Example 2-4 | 32 | 52 | 7 | 3 | 6 |
| Comparative Example 3-1 | 32 | 49 | 9 | 1 | 9 |
| Comparative Example 3-2 | 32 | 49 | 10 | 0 | 9 |
| Comparative Example 3-3 | 32 | 49 | 8 | 2 | 9 |

*expressed in wt % based on the total weight of the small tungsten alloy piece 11 in each of examples and comparative examples
The small tungsten alloy piece 11 according to each comparative example was fixed to the elliptical opening portion 10 of the golf club head 1 by welding in the same manner as in the examples.

Upon each of the golf club heads 1 welded with the small tungsten alloy pieces 11 obtained in the examples and the comparative examples, the welded portion was observed visually and a corrosion-resistance/weathering-resistance test was performed.

The corrosion-resistance/weathering-resistance test was carried out by a salt spray (cycle) test in which 5% salt water was sprayed to a test chamber set at 35° C. for evaluating the corrosion resistance and the corrosion behavior of a specimen.

Figure 6A:
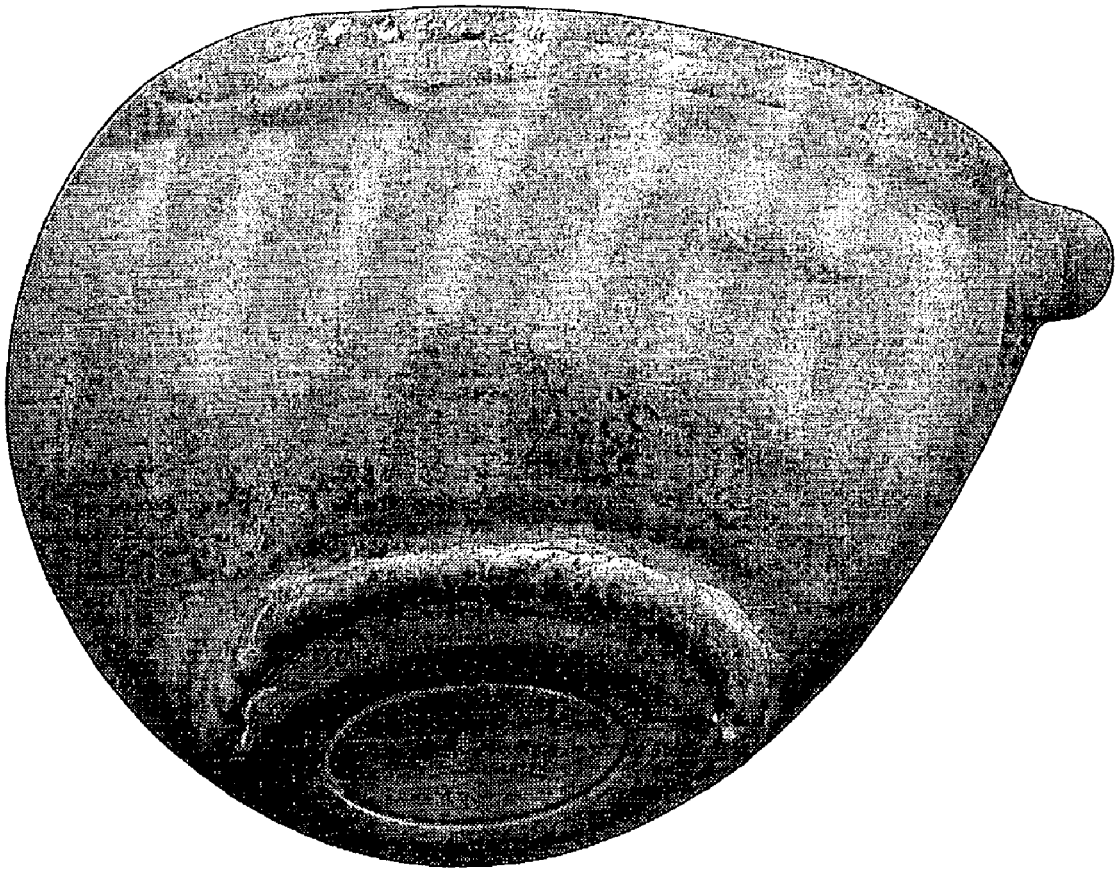
FIG. 6A is a view showing an external appearance of the welded portion in an example 1-1.
Figure 6B:
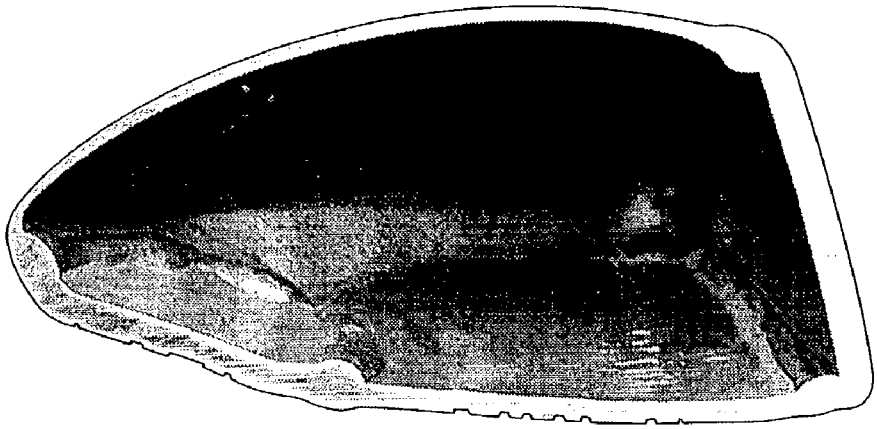
FIG. 6B is a view showing a section of the same portion.
Figure 6C:
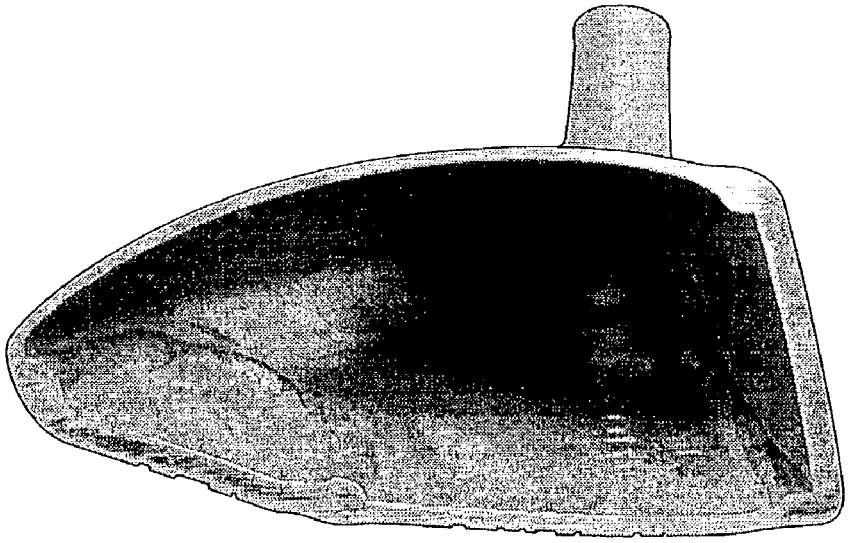
FIG. 6C is a view showing another section of the same portion.
Figure 7:
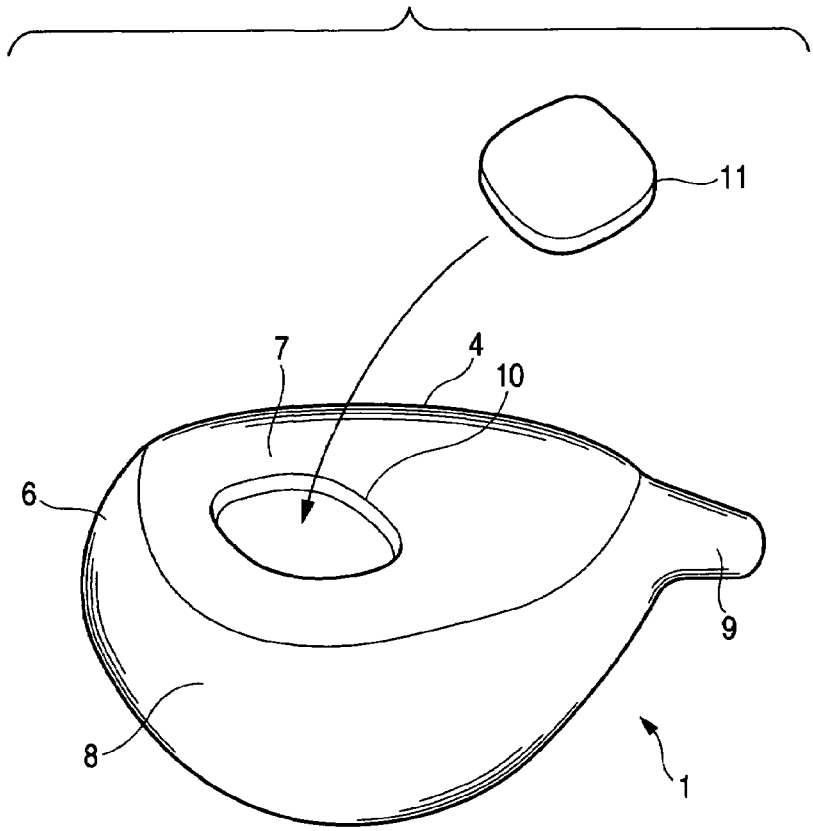
FIG. 7 is a view showing the golf club head and the tungsten alloy piece before fitting, separately.

Further, a section of the welded portion in each of examples and comparative examples was observed through a microscope. FIG. 6A is a view showing an external appearance of the welded portion in the example 1-1. FIG. 6B is a view showing a section of the same portion. FIG. 6C is a view showing another section of the same portion. The welding junction boundary between the small tungsten alloy piece 11 and the stainless steel of the golf club head 1 exhibited metallic silver color. There was no particularly clear boundary between the small tungsten alloy piece 11 and the golf club head 1. Thus, the small tungsten alloy piece 11 and the golf club head 1 were connected in good condition, and each portion had a substantially even texture. In addition, there is no particular failure in welding, and there was observed no welding defect such as a crack.

The welded portion in the comparative example 1-1 was observed in the same manner as in the example 1-1 after the welding. There was observed a difference in texture among the textures of the bead portion, the heat affected portion and the base metal portion. In addition, deposition of carbide on the grain boundary was conspicuous in the bead portion and the heat affected portion.

In each of examples, the small tungsten alloy piece 11 and the golf club head 1 were connected satisfactorily, and there was observed no particular defect in the welded portion. However, the textures of the welded portions in the comparative examples 1 to 3 were inferior in uniformity to those in the examples 1 and 2. It was recognized that such uniformity in texture had no little influence on strength or corrosion resistance.

Further, actual shots with the golf club head 1 according to each of examples were evaluated in a golf practice range so as to check occurrence of a crack or the like and occurrence of rust after the occurrence of the crack. However, there was no particular crack or the like, and there was observed no occurrence of rust even one week after the actual shot evaluation.

The specific gravity of the small tungsten alloy piece 11, the observation result of the welded portion and the evaluation result in the corrosion-resistance/weathering-resistance test in each of examples and comparative examples are shown in order in Table 4.

TABLE 4

| | specific gravity | observation result of welded portion | result in corrosion-resistance/ weathering-resistance test |
|---|---|---|---|
| Example 1-1 | 10.7 | ○ | ○ |
| Example 1-2 | 11.2 | ○ | ○ |
| Example 1-3 | 11.3 | ○ | ○ |
| Example 1-4 | 11.2 | ○ | ○ |
| Example 2-1 | 11.7 | ○ | ○ |
| Example 2-2 | 11.7 | ○ | ○ |
| Example 2-3 | 11.7 | ○ | ○ |
| Example 2-4 | 11.7 | ○ | ○ |
| Example 3-1 | 11.7 | ○ | ○ |

TABLE 4-continued

| | specific gravity | observation result of welded portion | result in corrosion-resistance/ weathering-resistance test |
|---|---|---|---|
| Example 3-2 | 12.1 | ○ | ○ |
| Example 3-3 | 11.7 | ○ | ○ |
| Comparative Example 1-1 | 10.9 | Δ | ○ |
| Comparative Example 1-2 | 11.2 | Δ | ○ |
| Comparative Example 1-3 | 11.3 | x | ○ |
| Comparative Example 1-4 | 11.3 | x | ○ |
| Comparative Example 2-1 | 11.7 | Δ | ○ |
| Comparative Example 2-2 | 11.7 | Δ | ○ |
| Comparative Example 2-3 | 11.7 | x | Δ |
| Comparative Example 2-4 | 11.6 | ○ | x |
| Comparative Example 3-1 | 11.6 | ○ | x |
| Comparative Example 3-2 | 11.6 | ○ | x |
| Comparative Example 3-3 | 11.6 | ○ | x |

As is also recognized in Table 4, it is confirmed that each of examples has no particular problem in the quantity of the welded portion and the result in the corrosion-resistance/weathering-resistance test. The golf club head 1 according to each of examples fulfills its function satisfactorily even if the golf club head 1 is used in practice in various weathers. However, in each of comparative examples, there occurred a nonmetal mediator in the welded portion or a failure in welding such as a crack (designated by the sign "x" in Table 4), or uniformity in texture between the welded portion and the base metal (small tungsten alloy piece 11 and golf club head 1) was observed (designated by the sign "Δ" in Table 4). In addition, in each of comparative examples, occurrence of rust particularly in the welded portion was observed (designated by the sign "x" in Table 4), or a change of color in the welded portion was observed (designated by the sign "Δ" in Table 4), in terms of the result in the corrosion-resistance/weathering-resistance test.

As described above, a golf club head according to the invention is provided with an opening portion in a part of a metal head body having a hollow portion, and a small tungsten alloy piece is fitted and joined to the opening portion by welding. Accordingly, the head body can be reduced in weight because of provision of the hollow portion. In addition, since the small tungsten alloy piece is joined to the opening portion by welding, difficult plastic forming is not required particularly. Thus, it is possible to adjust the weight easily and accurately.

What is claimed is:

1. A golf club head comprising:

a metal head body defining a hollow portion and an opening portion, the metal head body comprising a sole portion and a back portion; and a metal piece joined to the opening portion, wherein the metal piece includes tungsten alloy, and the following compositions based on the total weight of the metal piece:

tungsten in a range of 28 wt %-32 wt %;

iron in a range of 45 wt %-49 wt %;

nickel in a range of 15 wt %-17 wt %; and copper in a range of 1 wt %-3 wt %; and wherein the sum of amount of tungsten, iron, nickel and capper in the metal piece is in a range of 93 wt % to 98 wt %, wherein the metal head body is made of stainless steel, and wherein the metal piece is directly welded to the metal head body and wherein the metal piece extends generally from a vicinity of a central portion of the sole portion or from a vicinity of a rear of a center of the sole portion or from a vicinity of the metal head body that is rearward of the sole portion to a side wall of a back portion of the metal head body.

2. The golf club head according to claim 1, wherein specific gravity of the metal head body is not higher than 8.5.

3. The golf club head according to claim 1, wherein specific gravity of the metal piece is in a range of 10-12.

4. The golf club head according to claim 1, wherein the metal piece is produced by casting.

5. The golf club head according to claim 1, wherein sum of amount of Ni and Cu in the metal piece is in a range of 16 wt %-20 wt %.

6. A golf club head comprising:

a metal head body defining a hollow portion and an opening portion; and a metal piece including tungsten alloy, wherein the metal piece is joined to the opening portion by arc-welding the metal piece to the opening portion, and wherein the metal head body is made of stainless steel, and wherein the metal piece includes the following compositions based on the total weight of the metal piece:

tungsten in a range of 28 wt %-32 wt %;

iron in a range of 45 wt %-49 wt %;

nickel in a range of 15 wt %-17 wt %; and copper in a range of 1 wt %-3 wt %; and wherein the sum of amount of tungsten, iron, nickel, and copper in the metal piece is in a range of 93 wt % to 98 wt %.

7. The golf club head according to claim 6, wherein the metal piece is joined to the opening portion by:

fitting the metal piece to the opening portion with a gap therebetween; and arc-welding the metal piece to the opening portion.

8. The golf club head according to claim 6, wherein the metal piece includes iron.

9. The golf club bead according to claim 6, wherein specific gravity of the metal piece is in a range of 10-12.

* * * * *